US005829293A

United States Patent [19]

Cheng

[11] Patent Number: 5,829,293

[45] Date of Patent: Nov. 3, 1998

[54] AUTOMATIC SPRING FORMATION APPARATUS

[75] Inventor: Ming-Yih Cheng, Taoyuan, Taiwan

[73] Assignee: Minyu Machinery Corp., Ltd., Taoyuan, Taiwan

[21] Appl. No.: 886,591

[22] Filed: Jul. 1, 1997

[51] Int. Cl.[6] ..... B21F 3/04; B21F 3/02; B21J 9/18

[52] U.S. Cl. ..... 72/145; 72/135; 72/452.1

[58] Field of Search ..... 72/135, 137, 140, 72/142, 144, 145, 146, 42 Y, 452.1, 441, 404

[56] References Cited

U.S. PATENT DOCUMENTS

| | | | |
|---|---|---|---|
| 4,893,491 | 1/1990 | Ohadi et al. | 72/137 |
| 5,117,668 | 6/1992 | Philpot et al. | 72/135 |
| 5,452,598 | 9/1995 | Cheng | 72/137 |
| 5,657,657 | 8/1997 | Welsh et al. | 72/138 |

*Primary Examiner*—Joseph J. Hail, III
*Assistant Examiner*—Rodney Butler
*Attorney, Agent, or Firm*—Proskauer Rose LLP

[57] ABSTRACT

An automatic spring formation apparatus includes a frame on which a tool support plate is mounted. A plurality of tool sets are substantially angularly equally-spaced mounted on the support plate and extending in a radial direction with respect to a center of the support plate. Each of the tool sets has a slide mounted thereon and movable in the radial direction with a tool holder which holds a spring formation tool thereon fixed thereon to be movable toward/away from the center of the support plate. The tool sets are releasably fixed on the support plate and are selectively movable along a circular path about the center of the support plate for adjusting the angular positions thereof. A wire is fed through a hole formed on the center of the support plate to be acted upon by the tool for making a spring. The slide is provided with a cam follower and a cam driven by a motor is provided on the base plate to drivingly engage the cam follower so as to drive the tool to move in the radial direction. Springs are provided between the slide and the base plate to achieve a close engagement between the cam and the follower.

4 Claims, 5 Drawing Sheets

AUTOMATIC SPRING FORMATION APPARATUS

FIELD OF THE INVENTION

The present invention relates generally to an automatic spring formation apparatus and in particular to a direct cam-driving, computerized numeric control (CNC) spring formation apparatus.

BACKGROUND OF THE INVENTION

Automatic spring forming machines have already been known. For example, U.S. Pat. No. 5,452,598 discloses a CNC automatic spring formation apparatus, which is shown in FIG. 7 of the attached drawings. The prior art spring formation apparatus, which is designated at 100 in FIG. 7, comprises eight sets of spring formation tools 3 or 3' arranged on a work table 2 in a circular manner about a center point at which a spring to be formed is located. Each of the tool sets 3 or 3' comprises a tool supported on a tool seat 31 to be movable in a radial direction with respect to the center point by being driven by a servo motor via a four bar linkage 7. A control unit 5 having a monitor screen 51 is provided to control the operation of the apparatus 100.

Such a CNC apparatus, although providing flexibility in manufacturing process of different designs of spring, yet has disadvantages. For example, the pushing force that is generated on the tool that forms the spring is converted from he torque of the motor and such a conversion has a low efficiency in fully exploiting the output power of the motor.

It is therefore desirable to provide an automatic spring formation apparatus which overcomes the above-mentioned deficiencies.

SUMMARY OF THE INVENTION

The principal object of the present invention is to provide an automatic spring formation apparatus wherein the spring formation tools are independently driven by a cam-follower pair for more directly applying the output power of the motor that drives the cam-follower pair to the tool that forms the spring.

It is another object of the present invention to provide an automatic spring formation apparatus which provides a stronger output force to the tool that forms the spring so as to facilitate the formation of the spring.

Yet a further object of the present invention is to provide an automatic spring formation apparatus wherein a plurality of spring formation tool sets are provided on a support plate in such a manner to allow the tool sets to be movable along a circular path about a center of the support plate for adjusting the angular location of the tool sets.

To achieve the above objects, there is provided an automatic spring formation apparatus comprising a frame on which a tool support plate is mounted. A plurality of tool sets are substantially angularly equally-spaced mounted on the support plate and extending in a radial direction with respect to a center of the support plate. Each of the tool sets has a slide mounted thereon and movable in the radial direction with a tool holder which holds a spring formation tool thereon fixed thereon to be movable toward/away from the center of the support plate. The tool sets are releasably fixed on the support plate and are selectively movable along a circular path about the center of the support plate for adjusting the angular positions thereof. A wire is fed through a hole formed on the center of the support plate to be acted upon by the tool for making a spring. The slide is provided with a cam follower and a cam driven by a motor is provided on the base plate to drivingly engage the cam follower so as to drive the tool to move in the radial direction. Springs are provided between the slide and the base plate to achieve a close engagement between the cam and the follower.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
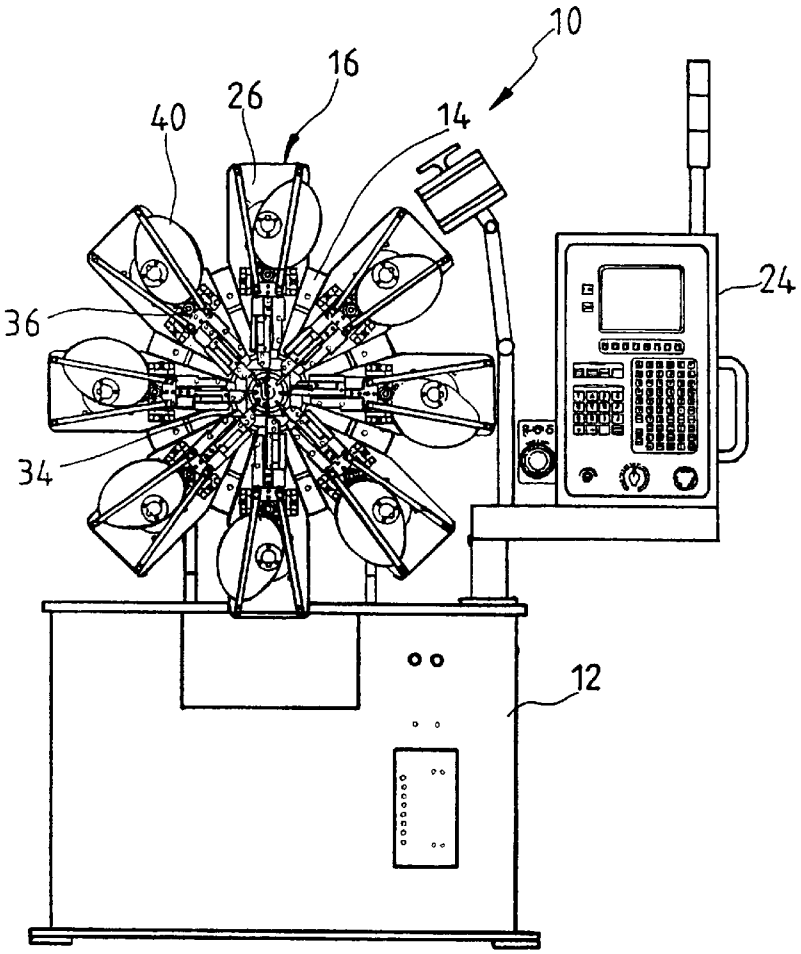
FIG. 1 is a front side view showing an automatic spring formation apparatus constructed in accordance with the present invention.
Figure 2:
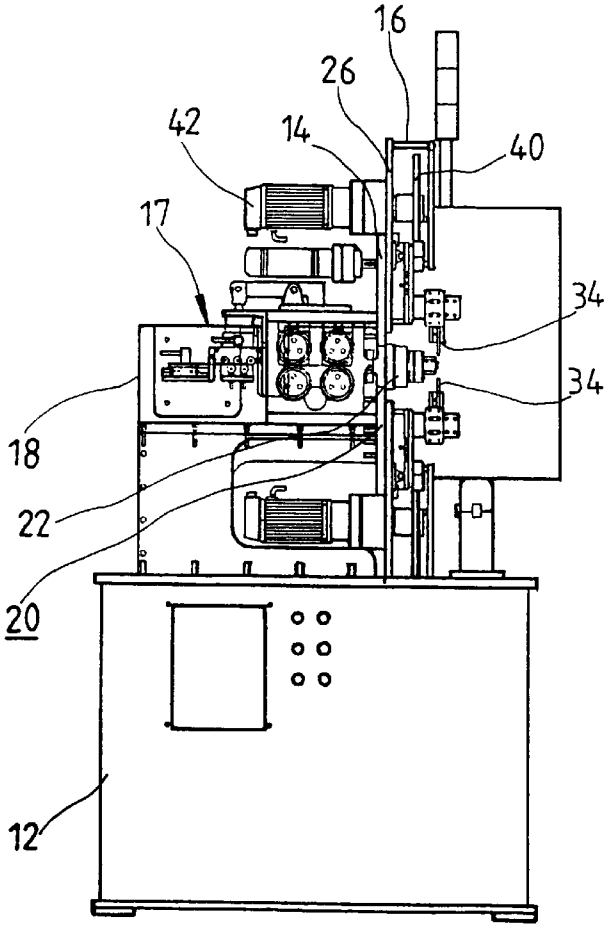
FIG. 2 is a side elevational view of the automatic spring formation apparatus in accordance with the present invention.

With reference to the drawings and in particular to FIGS. 1 and 2, wherein an automatic spring formation apparatus constructed in accordance with the present invention, generally designated by the reference numeral 10, is shown, the automatic spring formation apparatus 10 comprises a frame 12 on which a tool support plate 14 (particularly shown in FIGS. 5 and 6) which is circular in the embodiment illustrated is mounted. The tool support plate 14 has a front surface on which a plurality of tool sets 16 (eight in the embodiment illustrated) are mounted, preferably in an angularly equally-spaced manner and extending substantially radially from a center of the tool support plate 14, and a rear surface on which means 17 for feeding wire 18 that is used to make springs through a through hole 20 formed at the center of the tool support plate 14 is mounted. Wire holding means 22 is provided at the central hole 20 of the tool support plate 14 for holding and guiding the wire 18 in the formation of the spring.

The wire feeding means 18, as well as the wire holding means 22, is known (for example see U.S. Pat. No. 5,452,598 mentioned previously) and constitutes no part of the present invention so that no detail will be given herein.

A control device 24, which may be a microprocessor based controller and preferably a CNC controller, is provided on the frame 12 to control the operation of the automatic spring formation apparatus 10 of the present invention. Using a controller to control the operation of a machine is well known and thus will not be discussed herein.

Figure 3:
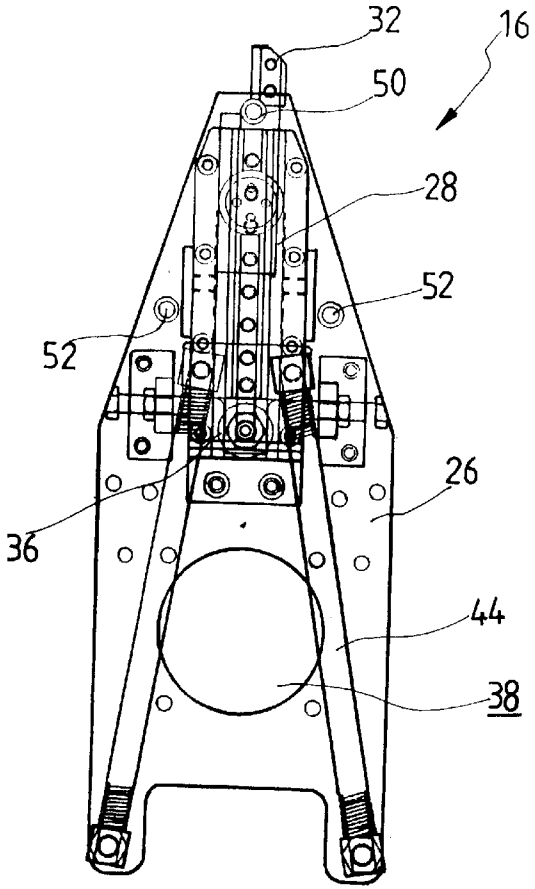
FIG. 3 is a front view showing a tool set comprising a base plate on which a tool holder driven by a cam-follower pair is mounted.
Figure 4:
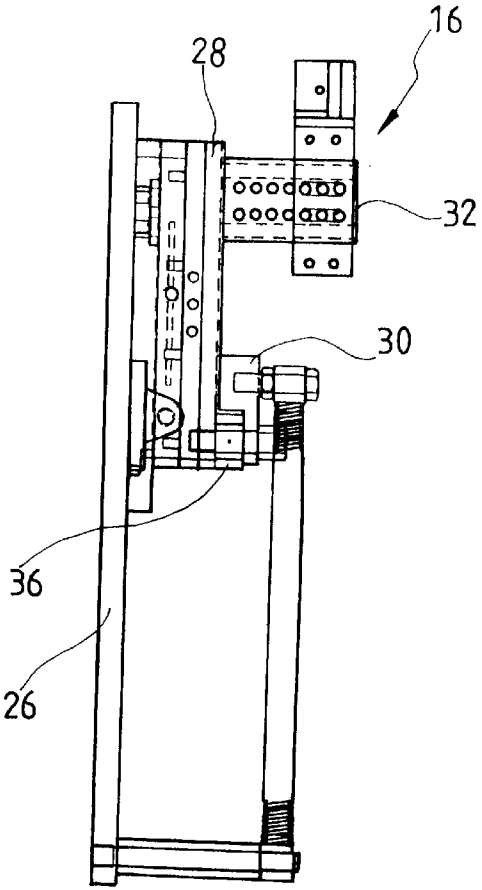
FIG. 4 is a side view of the tool set.

Also referring to FIGS. 3 and 4, each of the tool sets 16 comprises a base plate 26 mounted on the support plate 14, preferably in a location and orientation-adjustable manner to be further described hereinafter. Slide guide means, such as rail pair 28, is mounted on the base plate 26 on which a slide block 30 is movably mounted. A tool holder 32 which has a tool 34 releasably mounted thereon is fixed on and thus movable in unison with the slide block 30 along the slide guide means 28 in a substantially radial direction with respect to the center of the support plate 14.

The slide block 30 has a cam follower 36 rotatably fixed thereon. The base plate 26 is provided with a bore 38 defining a rotational axis at the center thereof. A cam 40 is rotatably supported in the bore 38 to drivingly engage the cam follower 36. The cam 40 is driven by for example a motor 42 which is mounted on the rear surface of the support plate 14 and drivingly coupled to the cam 40 through the bore 38. The motors 42 that drive the cams 40 of the tool sets 16 are controlled by the controller 24 preferably in an independent manner. The slide block 30 is biased by two springs 44 for a close engagement between the cam 40 and the cam follower 36. Each of the springs 44 has one end fixed to the slide block 30 and an opposite end fixed to the base plate 26.

The cam 40 is provided with a contour which allows a particular spring to be formed under the control of the controller 24.

Figure 5:
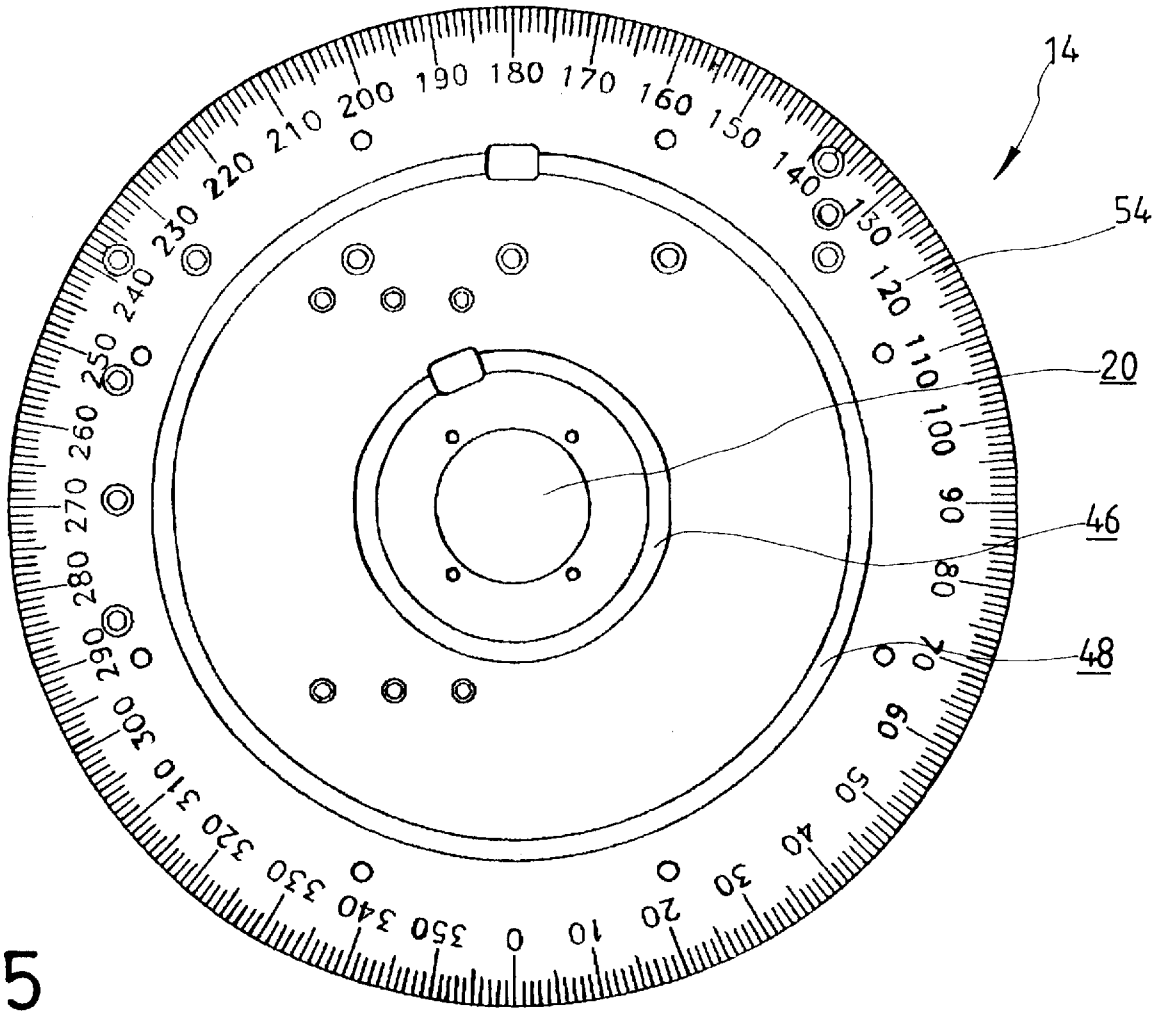
FIG. 5 is a plan view of tool support plate adapted in the automatic spring formation apparatus of the present invention.
Figure 6:
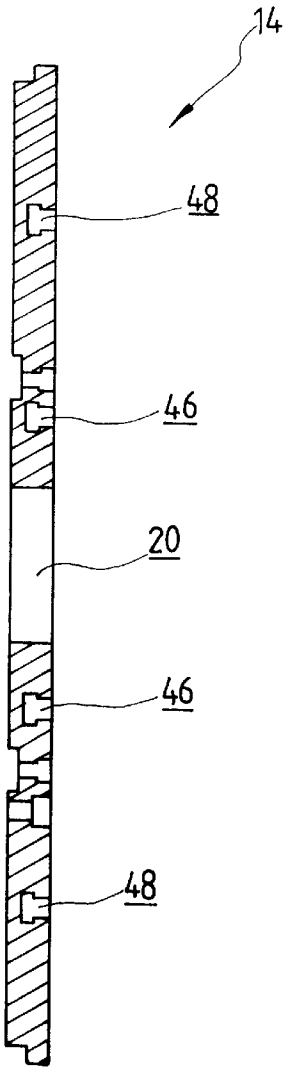
FIG. 6 is a cross-sectional view of the tool support plate.
Figure 7:
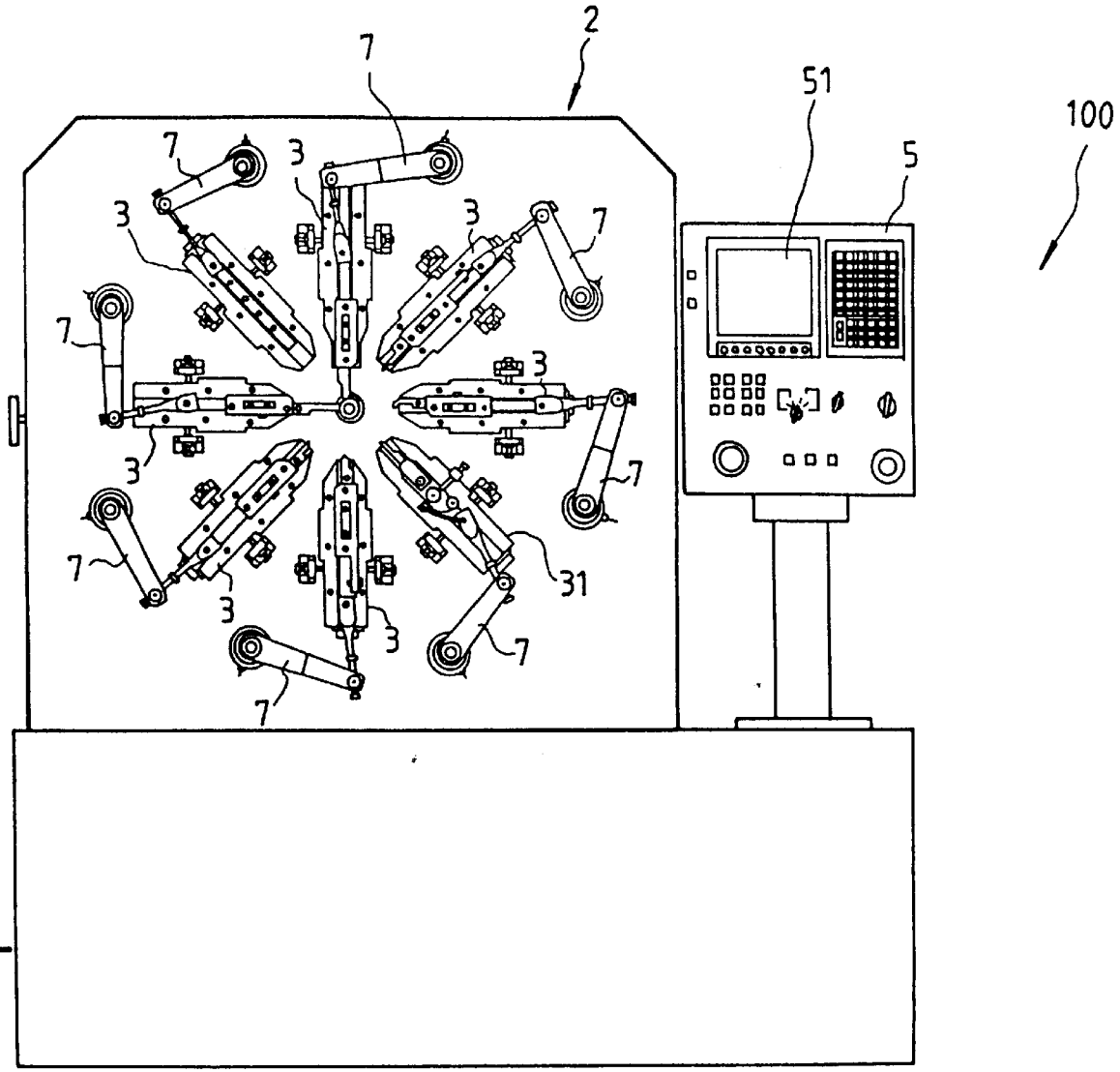
FIG.7 PRIOR ART
FIG. 7 is a front view showing a prior art spring formation apparatus.

As shown in FIGS. 5 and 6, the tool support plate 14 is circular in the embodiment illustrated, but may not need to be so. The tool support plate 14 comprises two circular grooves 46 (inner groove) and (outer groove) 48 which are concentric with respect to the central bore 20 of the tool support plate 14 and each having a T-shaped cross section to receive and hold therein inner threading fastener or outer fasteners (both not shown) which have expanded ends movably received within the grooves 46 or 48 and are corresponding to and engageable with counterpart inner and outer fasteners 50 and 52 provided on the base plate 26 of the respective tool set 16 so as to releasably secure the tool set 16 at a selective angular position relative to the central bore 20 of the support plate 14. Using such an arrangement to mechanically adjust the location of an object relative to another object is known, but has not yet been used in adjusting the angular position of a tool of a spring formation apparatus relative to the spring to be formed.

By releasing the engagement between the fasteners and the counterpart fasteners 50 and 52, the tool set 16 is allowed to move along the circular grooves 46 and 48 for adjusting the angular position thereof in order to achieve a desired relative angular position between the spring to be formed that is held by the wire holding means 22 located inside the central bore 20 of the support plate 14 and the tool 34 held on the tool holder 32 which is fixed on the tool set 16.

The tool support plate 14 may be provided with indexing marks 54, such as degrees of a circle as shown in FIG. 5, to indicate the angular positions of the tool sets 16.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A spring formation apparatus comprising:

a frame;

a tool support plat mounted on the frame, the tool support plate having a central through hole to receive a wire for making a spring form a wire feeding device;

a plurality of tool sets, each comprising a base plate mounted on the tool support plate, a slide being movably supported o the base plate to be movable substantially in a radial direction with respect to the central hole of the support plate, a tool holder being fixed on the slide to hold thereon a spring forming took, a cam follower being rotatably supported on the slide;

a cam rotatably supported on each of the base plates to be in driving engagement with the cam follower for driving the engagement with the cam follower for driving the slide and the tool holder to move in the radial direction with respect to the central hole of the support plate, biasing means being provided to bias the cam follower toward the cam in order to maintain close engagement therebetween; and control unit for controlling the feed of the wire by the wire feeding device and the movement of the tool holder and the respective tool by the cam and follower pair;

wherein the tool support plate comprises two circular grooves formed thereon to be concentric with respect to the central though hole thereof, each having a T-shaped cross section to receive and hold therein a first part of releasable fastener means and wherein the base plate of each of the tool sets comprises a second part of the releasable fastener means which is engageable with the first part to both releasably secure the base plate on the tool support plate and guide the base plate to move along the concentric circular grooves.

2. The spring formation apparatus as claimed in claim 1, wherein each of the cams comprises a driving device to rotate the cam, which driving device is controlled by the control unit.

3. The spring formation apparatus as claimed in claim 2, wherein the driving device comprises a motor.

4. The spring formation apparatus as claimed in claim 1, wherein the biasing means comprises two springs having one end fixed to the slide and an opposite end fixed to the base plate.

* * * * *